US007186164B2

(12) United States Patent
Manens

(10) Patent No.: US 7,186,164 B2
(45) Date of Patent: Mar. 6, 2007

(54) PROCESSING PAD ASSEMBLY WITH ZONE CONTROL

(75) Inventor: Antoine P. Manens, Mountain View, CA (US)

(73) Assignee: Applied Materials, Inc., Santa Clara, CA (US)

( * ) Notice: Subject to any disclaimer, the term of this patent is extended or adjusted under 35 U.S.C. 154(b) by 207 days.

(21) Appl. No.: 10/727,774

(22) Filed: Dec. 3, 2003

(65) Prior Publication Data

US 2005/0124262 A1 Jun. 9, 2005

(51) Int. Cl.
*B24B 49/00* (2006.01)

(52) U.S. Cl. ..... 451/5; 451/287; 451/529; 205/662; 205/663

(58) Field of Classification Search ..... 451/5, 451/10, 11, 41, 285, 287, 289, 36, 534, 530, 451/527, 529, 533; 205/661, 662, 663
See application file for complete search history.

(56) References Cited

U.S. PATENT DOCUMENTS

| | | | |
|---|---|---|---|
| 3,162,588 | A | 12/1964 | Bell |
| 3,448,023 | A | 6/1969 | Bell |
| 3,873,512 | A | 3/1975 | Latanision |
| 3,942,959 | A | 3/1976 | Markoo et al. |
| 3,992,178 | A | 11/1976 | Markoo et al. |
| 4,125,444 | A | 11/1978 | Inoue |
| 4,713,149 | A | 12/1987 | Hoshino |
| 4,793,895 | A | 12/1988 | Kaanta et al. |
| 4,839,005 | A | 6/1989 | Katsumoto et al. |
| 4,839,993 | A | 6/1989 | Masuko et al. |
| 4,934,102 | A | 6/1990 | Leach et al. |
| 4,954,141 | A | 9/1990 | Takiyama et al. |
| 4,956,056 | A | 9/1990 | Zubatova et al. |
| 5,061,294 | A | 10/1991 | Harmer et al. |
| 5,096,550 | A | 3/1992 | Mayer et al. |
| 5,108,463 | A | 4/1992 | Buchanan |
| 5,136,817 | A | 8/1992 | Tabata et al. |
| 5,217,586 | A | 6/1993 | Datta et al. |
| 5,225,034 | A | 7/1993 | Yu et al. |
| 5,257,478 | A | 11/1993 | Hyde et al. |
| 5,478,435 | A | 12/1995 | Murphy et al. |
| 5,534,106 | A | 7/1996 | Cote et al. |
| 5,543,032 | A | 8/1996 | Datta et al. |
| 5,562,529 | A | 10/1996 | Kishii et al. |
| 5,567,300 | A | 10/1996 | Datta et al. |
| 5,575,706 | A | 11/1996 | Tsai et al. |
| 5,578,362 | A | 11/1996 | Reinhardt et al. |
| 5,624,300 | A | 4/1997 | Kishii et al. |
| 5,637,031 | A | 6/1997 | Chen |
| 5,738,574 | A | 4/1998 | Tolles et al. |

(Continued)

FOREIGN PATENT DOCUMENTS

| | | |
|---|---|---|
| EP | 0 325 753 | 8/1989 |

(Continued)

OTHER PUBLICATIONS

International Search Report for PCT/US 02/11009 dated Feb. 6, 2003 (4100EP02).

(Continued)

*Primary Examiner*—Eileen P. Morgan
(74) *Attorney, Agent, or Firm*—Patterson & Sheridan

(57) ABSTRACT

An electrochemical mechanical processing station having a zoned polishing pad assembly is provided. The zoned polishing pad assembly includes a conductive layer coupled to an upper layer having a non-conductive processing surface. At least two zones of different current permeability are defined across the processing surface of the upper layer. Each zone is defined by an attribute of the upper layer.

18 Claims, 9 Drawing Sheets

U.S. PATENT DOCUMENTS 5,804,507 A 9/1998 Perlov et al.
5,807,165 A 9/1998 Uzoh et al.
5,823,854 A 10/1998 Chen
5,840,629 A 11/1998 Carpio
5,846,882 A 12/1998 Birang
5,871,392 A 2/1999 Meikle et al.
5,876,271 A 3/1999 Oliver
5,893,796 A 4/1999 Birang et al.
5,911,619 A 6/1999 Uzoh et al.
5,931,719 A 8/1999 Nagahara et al.
5,938,801 A 8/1999 Robinson
5,985,093 A 11/1999 Chen
6,001,008 A 12/1999 Fujimori et al.
6,004,880 A 12/1999 Liu et al.
6,010,395 A 1/2000 Nakajima
6,017,265 A 1/2000 Cook et al.
6,020,264 A 2/2000 Lustig et al.
6,024,630 A 2/2000 Shendon et al.
6,033,293 A 3/2000 Crevasse et al.
6,056,851 A 5/2000 Hsieh et al.
6,066,030 A 5/2000 Uzoh
6,074,284 A 6/2000 Tani et al.
6,077,337 A 6/2000 Lee
6,090,239 A 7/2000 Liu et al.
6,103,096 A 8/2000 Datta et al.
6,116,998 A 9/2000 Damgaard et al.
6,153,043 A 11/2000 Edelstein et al.
6,156,124 A 12/2000 Tobin
6,159,079 A 12/2000 Zuniga et al.
6,171,467 B1 1/2001 Weihs et al.
6,176,992 B1 1/2001 Talieh
6,183,354 B1 2/2001 Zuniga et al.
6,190,494 B1 2/2001 Dow
6,210,257 B1 4/2001 Carlson
6,234,870 B1 5/2001 Uzoh et al.
6,238,271 B1 5/2001 Cesna
6,238,592 B1 5/2001 Hardy et al.
6,244,935 B1 6/2001 Birang et al.
6,248,222 B1 6/2001 Wang
6,251,235 B1 6/2001 Talieh et al.
6,261,168 B1 7/2001 Jensen et al.
6,261,959 B1 7/2001 Travis et al.
6,273,798 B1 8/2001 Berman
6,297,159 B1 10/2001 Paton
6,319,420 B1 11/2001 Dow
6,328,642 B1 12/2001 Pant et al.
6,328,872 B1 12/2001 Talieh et al.
6,331,135 B1 12/2001 Sabde et al.
6,368,184 B1 4/2002 Beckage
6,381,169 B1 4/2002 Bocian et al.
6,386,956 B1 5/2002 Sato et al.
6,391,166 B1 5/2002 Wang
6,395,152 B1 5/2002 Wang
6,402,591 B1 6/2002 Thornton
6,402,925 B2 6/2002 Talieh
6,406,363 B1 6/2002 Xu et al.
6,409,904 B1 6/2002 Uzoh et al.
6,413,388 B1 7/2002 Uzoh et al.
6,413,403 B1 7/2002 Lindquist et al.
6,428,394 B1 8/2002 Mooring et al.
6,431,968 B1 8/2002 Chen et al.
6,440,295 B1 8/2002 Wang
6,447,668 B1 9/2002 Wang
6,464,855 B1 * 10/2002 Chadda et al. ..... 205/662
6,471,847 B2 10/2002 Talieh et al.
6,475,332 B1 11/2002 Boyd et al.
6,479,962 B2 11/2002 Ziemkowski et al.
6,482,307 B2 11/2002 Ashjaee et al.
6,497,800 B1 12/2002 Talieh et al.
6,517,426 B2 2/2003 Lee
6,537,144 B1 3/2003 Tsai et al.
6,551,179 B1 4/2003 Halley
6,561,889 B1 5/2003 Xu et al.
6,569,004 B1 5/2003 Pham
6,572,463 B1 6/2003 Xu et al.
6,585,579 B2 7/2003 Jensen et al.
6,630,059 B1 10/2003 Uzoh et al.
6,638,863 B2 10/2003 Wang et al.
6,666,959 B2 12/2003 Uzoh et al.
6,726,823 B1 4/2004 Wang et al.
6,736,952 B2 5/2004 Emesh
6,739,951 B2 5/2004 Sun et al.
6,802,955 B2 * 10/2004 Emesh et al. ..... 205/662
2001/0005667 A1 6/2001 Tolles et al.
2001/0024878 A1 9/2001 Nakamura
2001/0027018 A1 10/2001 Molnar
2001/0035354 A1 11/2001 Ashjaee et al.
2001/0036746 A1 11/2001 Sato et al.
2001/0040100 A1 11/2001 Wang
2001/0042690 A1 11/2001 Talieh
2002/0008036 A1 1/2002 Wang
2002/0011417 A1 1/2002 Talieh et al.
2002/0020621 A1 2/2002 Uzoh et al.
2002/0025760 A1 2/2002 Lee et al.
2002/0025763 A1 2/2002 Lee
2002/0070126 A1 6/2002 Sato
2002/0077037 A1 6/2002 Tietz
2002/0088715 A1 7/2002 Talieh et al.
2002/0108861 A1 8/2002 Emesh
2002/0119286 A1 8/2002 Chen et al.
2002/0123300 A1 9/2002 Jones et al.
2002/0130049 A1 9/2002 Chen et al.
2002/0130634 A1 9/2002 Ziemkowski et al.
2003/0114087 A1 6/2003 Duboust et al.
2003/0116445 A1 6/2003 Sun et al.
2003/0116446 A1 6/2003 Duboust et al.
2003/0129927 A1 7/2003 Lee et al.
2003/0213703 A1 11/2003 Wang et al.

FOREIGN PATENT DOCUMENTS

EP 0 455 455 4/1991
JP 10-6213 A 1/1998
JP 2870537 B 1/1999
JP 11-042554 2/1999
JP 2000-218513 A 8/2000
JP 2001-77117 3/2001
JP 2001-244223 A 9/2001
WO WO-1998-49723 11/1998
WO WO-1999-41434 8/1999
WO WO-1999-53119 10/1999
WO WO-2000-03426 1/2000
WO WO-2000-26443 5/2000
WO WO-2000-33356 6/2000
WO WO-2000-59682 10/2000
WO WO-2001-13416 2/2001
WO WO-2001-49452 7/2001
WO WO-2001-52307 7/2001
WO WO-2001-63018 8/2001
WO WO-2001-71066 9/2001
WO WO-2001-88229 11/2001
WO WO-2001-88954 11/2001
WO WO-2002-23616 3/2002
WO WO-2002-064314 8/2002
WO WO -2003-001581 1/2003

OTHER PUBLICATIONS

Contolini "Electrochemical Planarization of ULSI Copper," *Solid State Technology*; vol. 40, No. 6, Jun. 1, 1997, pp. 155-156, 158, 160, 162.

Nogami "*An Innovation to Integrate Porous Low-K Materials and Copper*", *Interconnect Japan 2001*; Honeywell Seminar (Dec. 6, 2001); pp. 1-12.

Alexander, et al., "Electrically Conductive Polymer Nanocomposite Materials," www.afrlhorizons.com/Briefs/Sept02/ML0206.html, date unknown.

PCT Written Opinion for PCT/US03/01760 dated Mar. 8, 2004 (AMAT/6339.PC).

* cited by examiner

PROCESSING PAD ASSEMBLY WITH ZONE CONTROL

BACKGROUND OF THE INVENTION

1. Field of the Invention

Embodiments of the present invention generally relate to a processing article for electrochemical mechanical processing.

2. Description of the Related Art

Electrochemical Mechanical Polishing (ECMP) is a technique used to remove conductive materials from a substrate surface by electrochemical dissolution while concurrently polishing the substrate with reduced mechanical abrasion as compared to conventional Chemical Mechanical Polishing (CMP) processes. Electrochemical dissolution is performed by applying a bias between a cathode and a substrate surface to remove conductive materials from the substrate surface into a surrounding electrolyte. The bias may be applied to the substrate surface by a conductive contact disposed on or through a polishing material upon which the substrate is processed. A mechanical component of the polishing process is performed by providing relative motion between the substrate and the polishing material that enhances the removal of the conductive material from the substrate.

Copper is one material that may be polished using electrochemical mechanical polishing. Typically, copper is polished utilizing a two-step process. In the first step, the bulk of the copper is removed, typically leaving some copper residue projecting above the substrate's surface. The copper residue is then removed in a second, or over-polishing, step.

However, the removal of copper residue may result in dishing of copper features below the plane of a surrounding material, typically an oxide or other barrier layer. The amount of dishing typically is related to polishing chemistries and processing parameters utilized in the over polish step, along with the width of the copper features subjected to polishing. As the copper layer does not have a uniform thickness across the substrate, it is difficult to remove all the copper residue without causing dishing over some features and not removing all of the copper residue over others. Thus, it would be advantageous to selectively adjust the polishing rate profile across the width of the substrate to enhance polishing performance and minimize dishing.

Thus, there is a need for an improved apparatus for electrochemical mechanical polishing.

SUMMARY OF THE INVENTION

Embodiments of the present invention generally provide an apparatus for processing a substrate in an electrochemical mechanical processing system. In one embodiment, a processing pad assembly for processing a substrate includes an upper non-conductive polishing layer coupled to a conductive lower layer. The conductive layer is adapted for coupling to a power source and the upper layer is adapted for processing a substrate thereon. At least two zones having different impedance are defined through the upper layer. The impedance of each zone is a characteristic of the upper layer.

In another embodiment of the invention, an electrochemical mechanical processing station having a zoned processing pad assembly is provided. The zoned processing pad assembly includes a conductive layer coupled to an upper layer having a non-conductive processing surface. At least two zones having different impedance are defined through the upper layer. The impedance of each zone is a characteristic of the upper layer.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings. It is to be noted, however, that the appended drawings illustrate only typical embodiments of this invention and are therefore not to be considered limiting of its scope, for the invention may admit to other equally effective embodiments.

To facilitate understanding, identical reference numerals have been used, where possible, to designate identical elements that are common to the figures.

DETAILED DESCRIPTION

The present invention generally relates to a processing pad assembly having multiple zones adapted to control the rate of removal of material from a substrate. The processing pad assembly includes an electrode and a non-conductive processing pad. The non-conductive processing pad includes at least two zones having different impedance defined therethrough. The impedance of each zone is a property of the non-conductive processing pad. The impedance of a zone may be measured by applying a voltage to the zone and then measuring the resulting electrical current in the zone. The impedance may then be expressed as the voltage applied to the zone divided by the current in the zone. The different impedance in the zones results in different currents in the zones at a given voltage. Therefore, because the rate of removal of material from the surface of the substrate is proportional to the current in the zone, the rate of removal may be locally controlled by controlling the impedance of the zones defined in the processing pad assembly. It is also contemplated that the processing pad assembly may be utilized for deposition of conductive material on the substrate by reversing the polarity of the of the bias applied between the substrate and the electrode.

Figure 1:
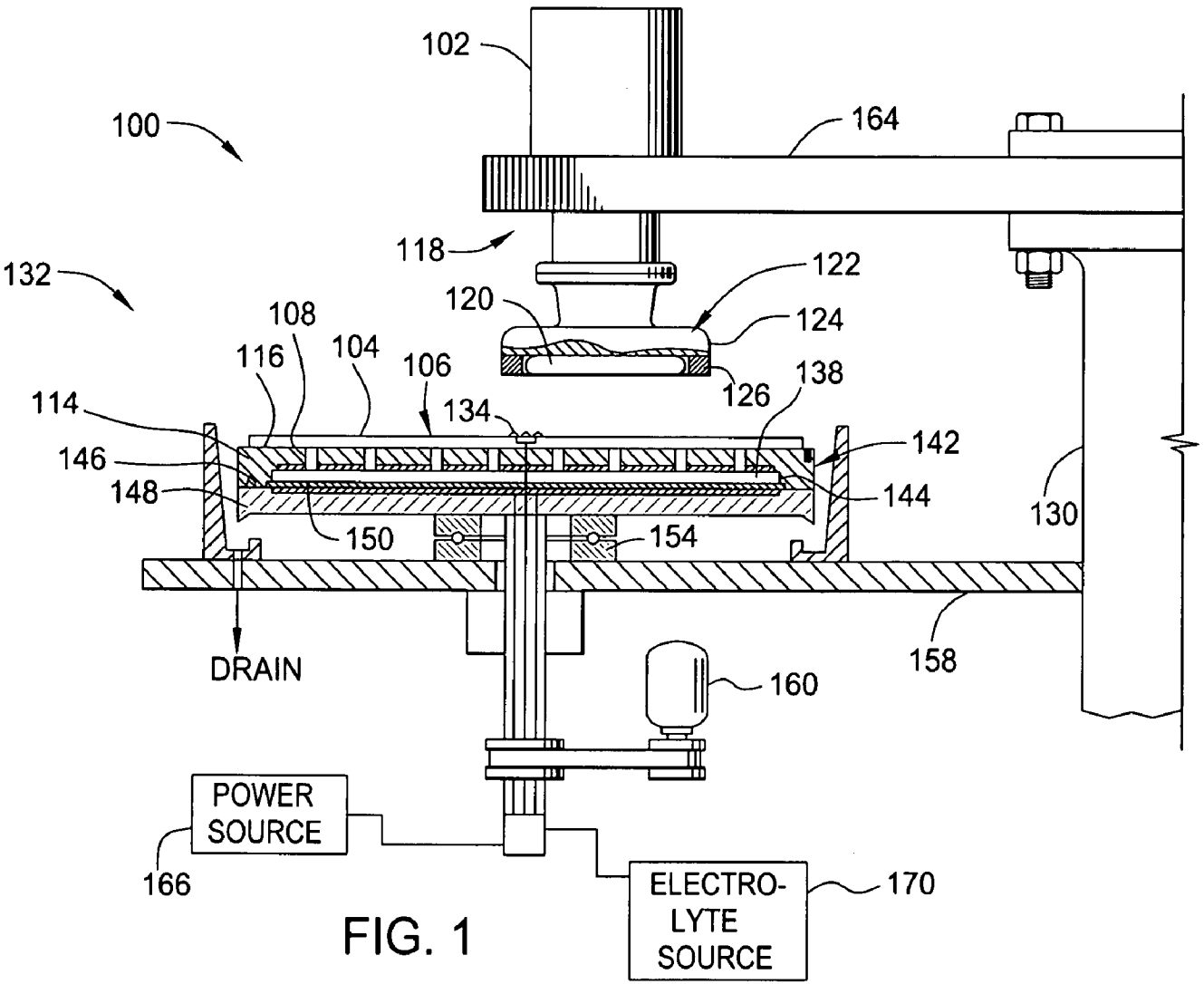
FIG. 1 is a side view, partially in cross-section, of a processing station of an electrochemical mechanical processing system having a zoned processing pad assembly.

FIG. 1 depicts a sectional view of a processing station 100 having one embodiment of a zoned processing pad assembly 106 of the present invention. The processing station 100 includes a carrier head assembly 118 adapted to hold a substrate 120 against a platen assembly 142. Relative motion is provided therebetween to process (e.g., polish or deposit material on) the substrate 120. The relative motion may be rotational, lateral, or some combination thereof and may be provided by either or both of the carrier head assembly 118 and the platen assembly 142.

In one embodiment, the carrier head assembly 118 is adapted to hold a substrate 120 against a platen assembly 142 disposed in an ECMP station 132. The carrier head assembly 118 is supported by an arm 164 coupled to a base 130 and which extends over the ECMP station 132. The ECMP station may be coupled to or disposed proximate the base 130.

The carrier head assembly 118 generally comprises a drive system 102 coupled to a carrier head 122. The drive system 102 generally provides at least rotational motion to the carrier head 122. The carrier head 122 additionally may be actuated toward the ECMP station 132 such that the substrate 120 retained in the carrier head 122 may be disposed against a processing surface 104 of the ECMP station 132 during processing.

In one embodiment, the carrier head 122 may be a TITAN HEAD™ or TITAN PROFILER™ wafer carrier manufactured by Applied Materials, Inc., of Santa Clara, Calif. Generally, the carrier head 122 comprises a housing 124 and retaining ring 126 that define a center recess in which the substrate 120 is retained. The retaining ring 126 circumscribes the substrate 120 disposed within the carrier head 122 to prevent the substrate from slipping out from under the carrier head 122 while processing. It is contemplated that other carrier heads may be utilized.

The ECMP station 132 generally includes a platen assembly 142 rotationally disposed on a base 158. A bearing 154 is disposed between the platen assembly 142 and the base 158 to facilitate rotation of the platen assembly 142 relative to the base 158. The platen assembly 142 is typically coupled to a motor 160 that provides the rotational motion to the platen assembly 142.

The platen assembly 142 has an upper plate 114 and a lower plate 148. The upper plate 114 may be fabricated from a rigid material, such as a metal or rigid plastic, and in one embodiment, is fabricated from or coated with a dielectric material, such as CPVC. The upper plate 114 may have a circular, rectangular or other planar form. A top surface 116 of the upper plate 114 supports the zoned processing pad assembly 106 thereon. The zoned processing pad assembly 106 may be held to the upper plate 114 of the platen assembly 142 by magnetic attraction, static attraction, vacuum, adhesives, or the like.

The lower plate 148 is generally fabricated from a rigid material, such as aluminum and may be coupled to the upper plate 114 by any conventional means, such as a plurality of fasteners (not shown). Generally, a plurality of locating pins 146 (one is shown in FIG. 1) are disposed between the upper and lower plates 114, 148 to ensure alignment therebetween. The upper plate 114 and the lower plate 148 may optionally be fabricated from a single, unitary member.

A plenum 138 is defined in the platen assembly 142 and may be partially formed in at least one of the upper or lower plates 114, 148. In the embodiment depicted in FIG. 1, the plenum 138 is defined in a recess 144 partially formed in the lower surface of the upper plate 114. At least one hole 108 is formed in the upper plate 114 to allow electrolyte, provided to the plenum 138 from an electrolyte source 170, to flow through the platen assembly 142 and into contact with the substrate 120 during processing. The plenum 138 is partially bounded by a cover 150 coupled to the upper plate 114 enclosing the recess 144. Alternatively, the electrolyte may be dispensed from a pipe (not shown) onto the top surface of the processing pad assembly 106.

At least one contact assembly 134 is disposed on the platen assembly 142 along with the processing pad assembly 106. The at least one contact assembly 134 extends at least to or beyond the upper surface of the processing pad assembly 106 and is adapted to electrically couple the substrate 120 to a power source 166. The processing pad assembly 106 is coupled to a different terminal of the power source 166 so that an electrical potential may be established between the substrate 120 and processing pad assembly 106.

Figure 2:
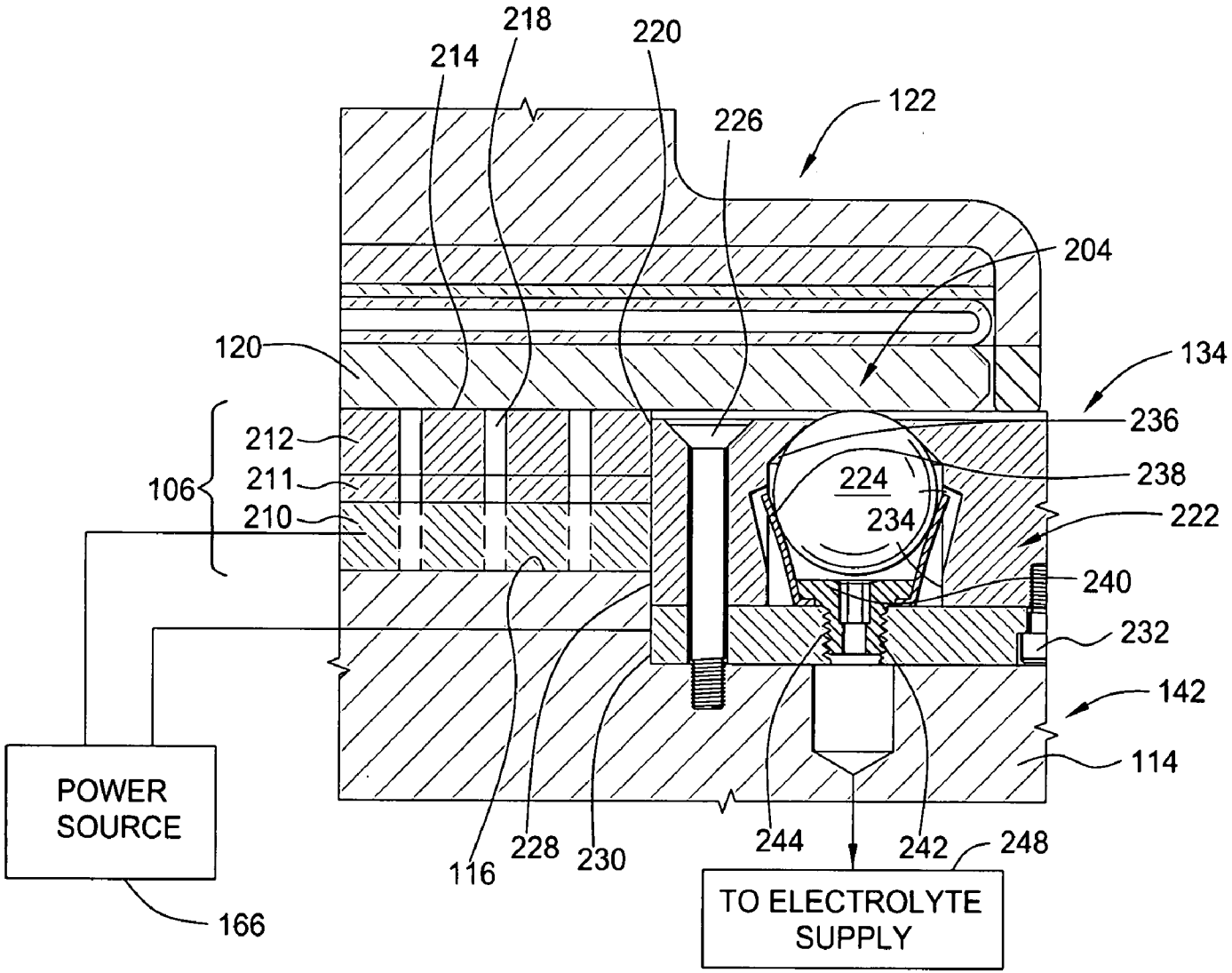
FIG. 2 is a partial sectional view of one embodiment of a platen and zoned processing pad assembly of the polishing station of FIG. 1.

FIG. 2 depicts a partial sectional view of the zoned processing pad assembly 106 and contact assembly 134 of FIG. 1. The zoned processing pad assembly 106 includes at least a conductive lower layer, or electrode, 210 and a non-conductive upper layer 212. In the embodiment depicted in FIG. 2, an optional subpad 211 is disposed between the upper and lower layers, 210, 212. The optional subpad 211 may be used in any of the embodiments of the zoned processing pad assembly discussed herein. The subpad 211 and layers 210, 212 of the zoned processing pad assembly 106 are combined into a unitary assembly by the use of adhesives, bonding, compression molding, or the like.

The subpad 211 is typically fabricated from a material softer, or more compliant, than the material of the upper layer 212. The difference in hardness or durometer between the upper layer 212 and the subpad 211 may be chosen to produce a desired polishing/plating performance. The subpad 211 may also be compressive. Examples of suitable subpad 211 materials include, but are not limited to, foamed polymer, elastomers, felt, impregnated felt and plastics compatible with the processing chemistries.

The conductive lower layer 210 is disposed on the top surface 116 of the upper plate 114 of the platen assembly 142 and is coupled to the power source 166 through the platen assembly 142. The lower layer 210 is typically comprised of a conductive material, such as stainless steel, copper, aluminum, gold, silver and tungsten, among others. The lower layer 210 may be solid, impermeable to electrolyte, permeable to electrolyte, perforated, or a combination thereof. In the embodiment depicted in FIG. 2, the lower layer 210 is configured to allow electrolyte flow therethrough.

In one embodiment, at least one permeable passage 218 is disposed at least through the upper layer 212 and extends at least to the lower layer 210. Alternatively, the passage 218 may extend completely through the upper layer 212 and the lower layer 210 (as shown in phantom). The passage 218 allows an electrolyte to establish a conductive path between the substrate 120 and the lower layer 210. In one embodiment, the passage 218 comprises a permeable portion of the upper layer 212. In another embodiment, the passage 218 is a hole formed in the upper layer 212.

The upper layer 212 may be fabricated from polymeric materials compatible with process chemistry, examples of which include polyurethane, polycarbonate, fluoropolymers, PTFE, PTFA, polyphenylene sulfide (PPS), or combinations thereof, and other processing materials used in substrate processing surfaces. In one embodiment, a processing surface 214 of the upper layer 212 of the zoned processing pad assembly 106 is dielectric, for example, polyurethane or other polymer. Examples of processing pad assemblies that may be adapted to benefit from the invention are described in U.S. patent application Ser. No. 10/455,941, filed Jun. 6, 2003 by Y. Hu et al. (entitled "CONDUCTIVE POLISHING ARTICLE FOR ELECTROCHEMICAL MECHANICAL POLISHING", and U.S. patent application Ser. No. 10/455,895, filed Jun. 6, 2003 by Y. Hu et al. (entitled "CONDUCTIVE POLISHING ARTICLE FOR ELECTROCHEMICAL MECHANICAL POLISHING", both of which are hereby incorporated by reference in their entireties.

At least one aperture 220 is formed in the layers 210, 212 and optional subpad 211 of the zoned processing pad assembly 106. Each of the at least one aperture 220 is of a size and location to accommodate a contact assembly 134 disposed therethrough. In one embodiment, the at least one aperture 220 is a single aperture formed in the center of the processing pad assembly 106 to accommodate a single contact assembly 134.

A contact element 238 of the contact assembly 134 that is disposed on the upper layer 114 of the platen assembly 142 is coupled to the power source 166. Although only one contact assembly 134 is shown coupled to the upper layer 114 of the platen assembly 142 in FIG. 2, any number of contact assemblies 134 may be utilized and may be distributed in any number of configurations on the upper layer 114 of the platen assembly 142.

In one embodiment, the contact assembly 134 includes a ball assembly 204 that is generally coupled to the upper plate 114 of the platen assembly 142 and extends at least partially through the aperture 220 formed in the zoned processing pad assembly 106. The ball assembly 204 includes a housing 222 that retains a plurality of balls 224 (one shown in FIG. 2).

The housing 222 is removably coupled to the upper layer 114 of the platen assembly 142 to facilitate replacement of the ball assembly 204 after a number of processing cycles. In one embodiment, the housing 222 is coupled to the upper layer 114 by a plurality of screws 226. The housing 222 includes an upper housing 228 coupled to a lower housing 230 that retain the balls 224 therebetween. The upper housing 228 is fabricated from a dielectric material compatible with process chemistries. In one embodiment, the upper housing 228 is made of PEEK. The lower housing 230 is fabricated from a conductive material compatible with process chemistries. In one embodiment, the lower housing 230 is made of stainless steel. The lower housing 230 is coupled to the power source 166. The housings 228, 230 may be coupled in any number of methods, including but not limited to, screwing, bolting, riveting, bonding, staking and clamping, among others. In the embodiment depicted in FIG. 2, the housings 228, 230 are coupled by a plurality of screws 232.

The balls 224 are movably disposed in a plurality of apertures 234 formed through the housings 228, 230, and may be disposed in a first position having at least a portion of the balls 224 extending above the processing surface 214 and at least a second position (shown in FIG. 2) where the balls 224 are flush with the processing surface 214. An upper portion of each of the apertures 234 includes a seat 236 that extends into the aperture 234 from the upper housing 228. The seat 236 is configured to prevent the ball 224 from exiting the top end of the aperture 234.

A contact element 238 is disposed in each aperture 234 to electrically couple the ball 224 to the lower housing 230. Each of the contact elements 238 are coupled to the lower housing 230 by a respective clamp bushing 240. In one embodiment, a post 242 of the clamp bushing 240 is threaded into a threaded portion 244 of the aperture 234 formed through the housing 222. The balls 224 are made of conductive material and are electrically coupled through the contact element 238 and the lower housing 230 to the power source 166 for electrically biasing the substrate 120 during processing.

An electrolyte source 248 provides electrolyte through the apertures 234 and into contact with the substrate 120 during processing. During processing, the balls 224 disposed within the housing 222 are actuated towards the processing surface 214 by at least one of spring, buoyant or flow forces. The balls 224 electrically couple the substrate 120 to the power source 166 through the contact elements 238 and lower housing 230. Electrolyte, flowing through the housing 222 provides a conductive path between the lower layer 210 and biased substrate 120 thereby driving an electrochemical polishing (or plating) process.

Figure 3A:
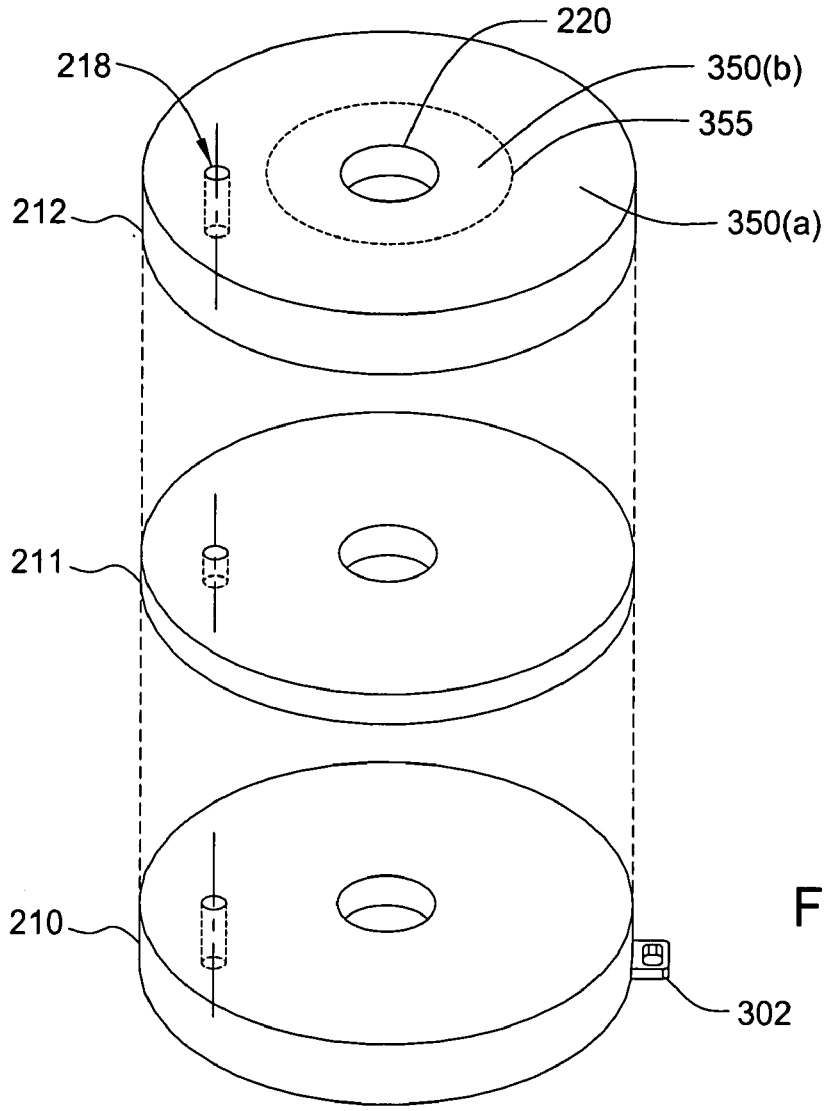
FIG. 3A is an exploded isometric of one embodiment of a zoned processing pad assembly of the polishing station of FIG. 1.
Figure 3B:
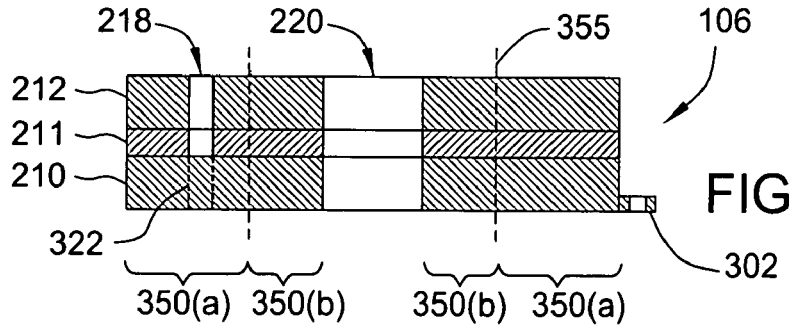
FIG. 3B is a sectional side view of the embodiment of a zoned processing pad assembly depicted in FIG. 3A.

FIGS. 3A and 3B depict sectional side and exploded isometric views of one embodiment of the zoned processing pad assembly 106. The processing pad assembly 106 includes at least two conductive zones, shown as zones 350(*a*) and 350(*b*) in FIGS. 3A and 3B. The zones 350 have different impedance, thereby causing a different current to flow through the processing pad assembly 106 at a given voltage during the processing of a substrate. The impedance of the zone may be selectively altered by, for example, controlling the total open area of the upper layer 212, which, in turn, controls the amount of the electrolyte in each zone. The open area is defined as the opposite of the solid area—i.e., the area taken up by open, permeable spaces and may be created by, for example, perforating the upper layer and subpad of the processing pad assembly with a plurality of holes in each of the zones and changing the spacing of the holes in each zone; or by changing the diameter of the holes. Alternatively the upper layer and subpad could be made of a permeable material with a different porosity or permeability in each of the zones. The zones can be manipulated by any combination of these methods which result in promotion of different current densities in each zone.

In the embodiment depicted in FIGS. 3A and 3B, the zones 350(*a*) and 350(*b*) are concentric rings of roughly equal radial width. However, it is contemplated that the size, shape, number, and location of zones may be configured such as to advantageously promote current densities in locations which result in uniform removal of material across the surface of the substrate being polished.

In one embodiment, the permeable passage 218 is a plurality of holes 318 formed in and through the upper layer 212 and the optional subpad 211 to allow an electrolyte to flow therethrough and come into contact with the lower layer 210 during processing. For clarity and ease of understanding, only one hole 318 is shown extending through the upper layer 212 and optional subpad 211. Alternatively, the upper layer 212 may be formed of a permeable material which allows the electrolyte to flow therethrough to form a conductive path between the lower layer 210 and the substrate 120 during processing. The subpad 211, when present, may also be formed of a permeable material.

Optionally, an extension 322 of the permeable passage 218 may be formed in and at least partially through the lower layer 210 (shown in phantom) in order to increase the surface area of the conductive lower layer 210 in contact with the electrolyte. The extension 322 may extend completely through the lower layer 210. A terminal 302 extends from the lower layer 210 to facilitate a connection to the power source 166 (shown in FIGS. 1 and 2).

Figure 4:
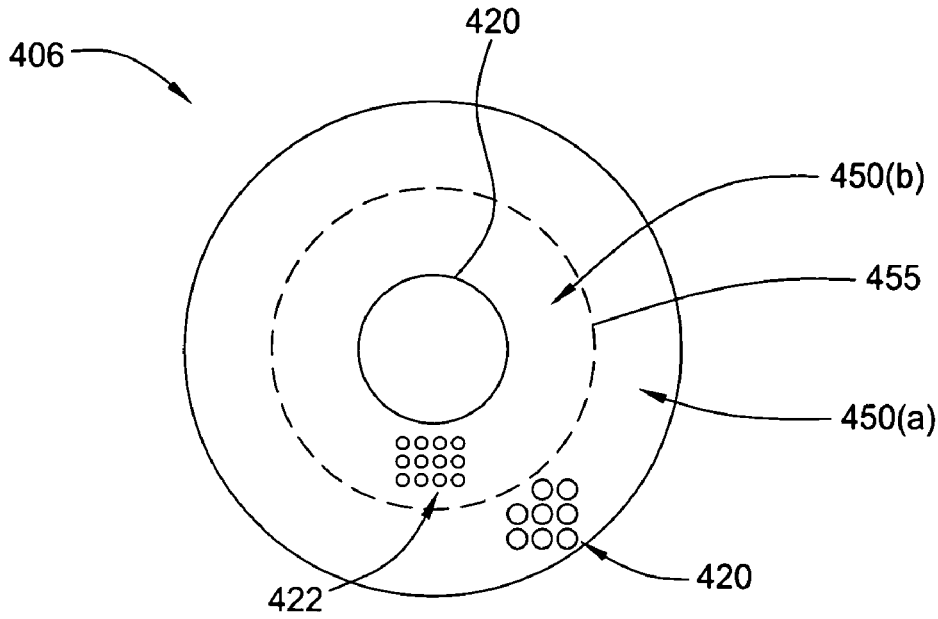
FIG. 4 is a plan view of one embodiment of a zoned processing pad assembly of the processing station of FIG. 1.

FIG. 4 depicts another embodiment of a processing pad assembly 406 having at least conductive zones 450(*a*) and 450(*b*), illustratively shown divided by a dashed line 455. The zones 450 are each adapted to have a different impedance. A first plurality of holes 420 are formed through the processing pad assembly 406 in zone 450(*a*). The holes 420 have a diameter and spacing which define the impedance of the zone 450(*a*). A second plurality of holes 422 are formed through the processing pad assembly 406 in zone 450(*b*). The holes 420, 422 are configured to have a different open area (i.e., percent of surface area of the processing pad assembly 406 taken up by the holes). In the embodiment depicted in FIG. 4, the second holes 422 have the same spacing as, but a different diameter than, the first holes 420 in order to define an impedance of the zone 450(*b*) that is different than the impedance of the zone 450(*a*).

Figure 5:
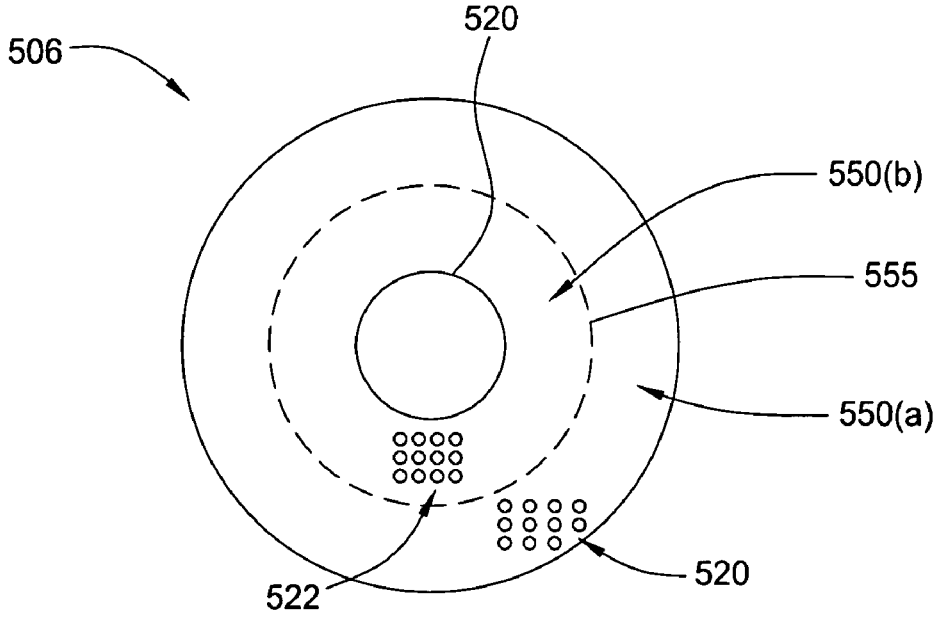
FIG. 5 is a plan view of another embodiment of a zoned processing pad assembly of the processing station of FIG. 1.

FIG. 5 depicts another embodiment of a processing pad assembly 506 having at least two conductive zones 550(*a*) and 550(*b*), illustratively shown divided by a dashed line 555. The zones 550 each have a different impedance. A first plurality of holes 520 are formed through the processing pad assembly 506 in zone 550(*a*). The holes 520 have a diameter and spacing which define an impedance of the zone 550(*a*). A second plurality of holes 522 are formed through the processing pad assembly 506 in zone 550(*b*). The holes 522 have the same diameter as, but a different spacing than, the holes 520 in order to define an impedance of the zone 550(*b*) that is different than the impedance of the zone 550(*a*).

Figure 6A:
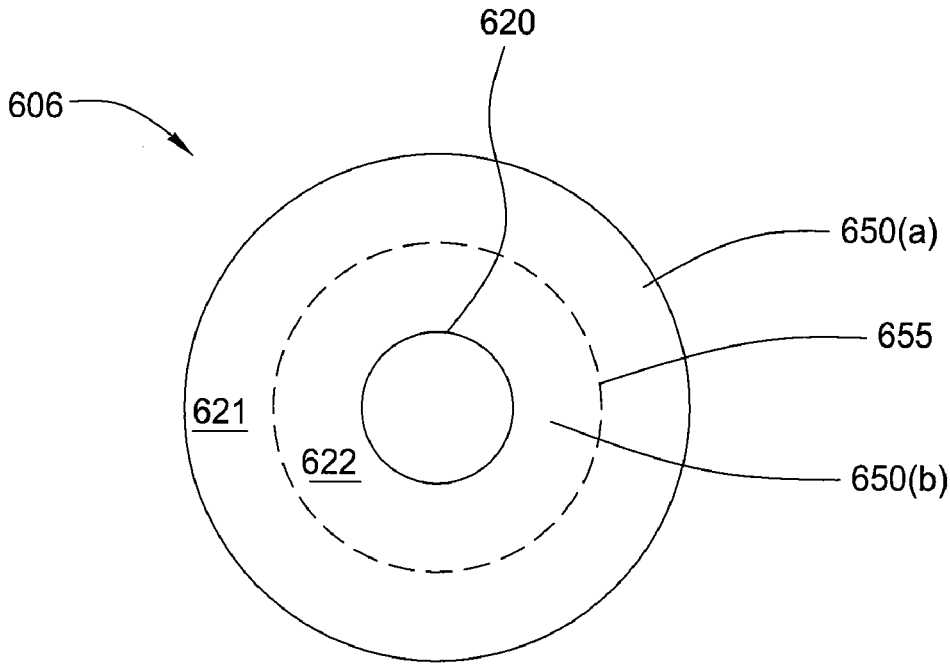
FIG. 6A is a plan view of another embodiment of a zoned processing pad assembly of the processing station of FIG. 1.
Figure 6B:
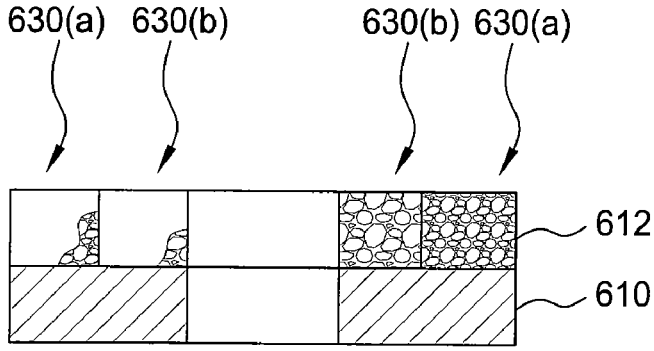
FIG. 6B is a side view of the zoned processing pad assembly of FIG. 6A.

FIGS. 6A and 6B depict a plan and a sectional view of another embodiment of a processing pad assembly 606 of the present invention. The processing pad assembly 606 has at least two conductive zones 650(*a*) and 650(*b*), illustratively shown divided by a dashed line 655. The zones 650 each have a different impedance. In this embodiment, a processing layer 612 is fabricated from a permeable material, and optionally may also include holes for partially contributing to the current permeability of each zone. The processing layer 612 has two concentric rings of material coupled together to form the zones 650(*a*) and 650(*b*). An outer ring 621 has a first porosity which defines an impedance of the zone 650(*a*). An inner ring 622 has a second porosity in order to define an impedance of the zone 650(*b*) that is different than the impedance of the zone 650(*a*).

The processing pad assemblies 406, 506, 606 depicted in FIGS. 4, 5, and 6 may include one or more apertures 420, 520, 620 to facilitate interfacing with one or more conductive elements, such as the ball assemblies depicted in FIG. 2.

It is contemplated that more than two zones may be created, each with independent impedances which may or may not be the same as the impedance of some of the other zones. Moreover, the impedance of each zone may be maintained by a combination of the embodiments depicted above. For example, different size holes with different spacing may be used, or holes in one zone and permeable processing layers in others. Furthermore, the zones do not need to be concentric, nor of any given shape.

Figure 7:
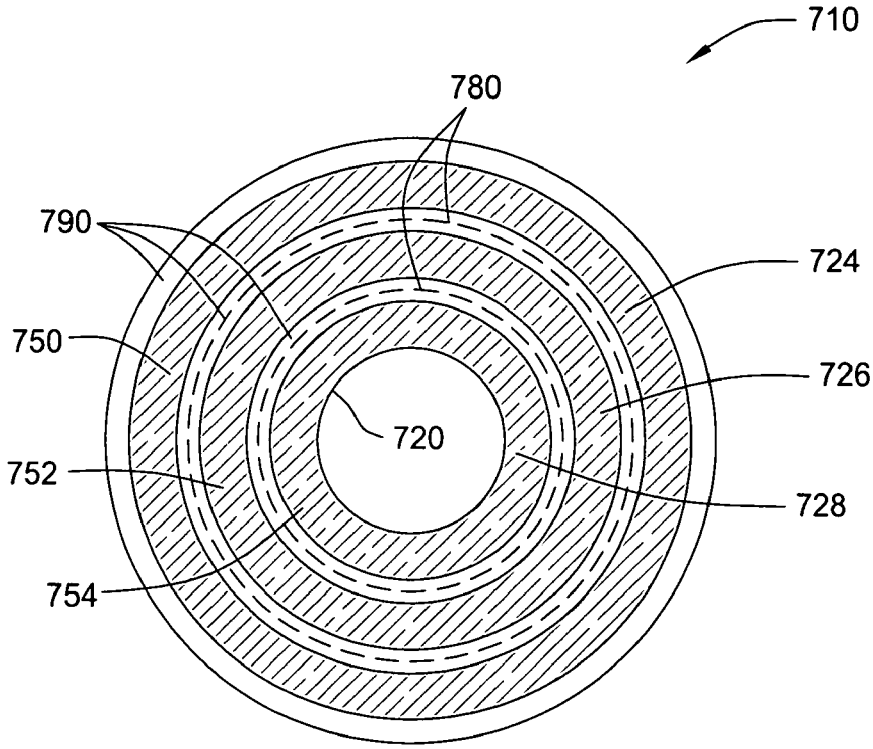
FIG. 7 is a plan view of one embodiment of an electrode of a zoned processing pad assembly of the processing station of FIG. 1.
Figure 8:
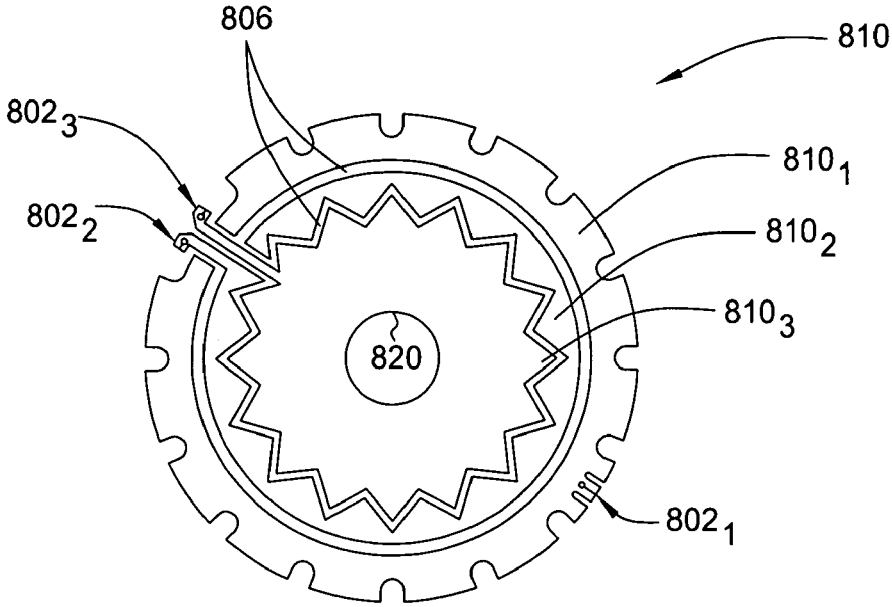
FIG. 8 is a plan view of another embodiment of an electrode of a zoned processing pad assembly of the processing station of FIG. 1.

FIGS. 7 and 8 show bottom views of alternative embodiments of electrodes having multiple zones that may be advantageously adapted for use with the various embodiments of the invention described herein. In FIG. 7, the electrode 710 includes at least one dielectric spacer 790 and at least two conductive elements. The conductive elements are arranged to create a plurality of independently biasable zones across the surface of the electrode 710. In the embodiment depicted in FIG. 7, the electrode 710 has at three conductive elements 750, 752, 754 that are electrically isolated from each other by the spacers 790 to create electrode zones, an outer electrode zone 724, an intermediate electrode zone 726, and an inner electrode zone 728. Each electrode zone 724, 726, 728, shown separated by the dashed boundary 780, may be independently biasable to allow the substrate polishing (or deposition) profile to be tailored. One example of a polishing method having electrode zone bias control is described in U.S. patent application Ser. No. 10/244,697, filed Sep. 16, 2002, which is hereby incorporated by reference in its entirety.

Although the electrode zones 724, 726, 728 and conductive elements 750, 752, 754 are shown as concentric rings, the electrode zones may be alternatively configured to suit a particular polishing application. For example, the electrode zones 724, 726, 728 and/or conductive elements 750, 752, 754 may be linear, curved, concentric, involute curves or other shapes and orientations are possible for the conductive elements. The electrode zones 724, 726, 728 and/or conductive elements 750, 752, 754 may be of substantially equal sizes and shapes from one zone to the next, or the sizes and shapes may vary depending upon the particular zone of concern.

FIG. 8 depicts another embodiment of an electrode 810 having a plurality of independently biasable electrode zones. In one embodiment, the electrode 810 has at least n zone electrodes (shown as three electrodes $\mathbf{810}_1$, $\mathbf{810}_2$, and $\mathbf{810}_3$), wherein n is an integer of 2 or greater. The electrodes $\mathbf{810}_1$, $\mathbf{810}_2$, and $\mathbf{810}_3$ each include a respective terminal $\mathbf{802}_1$, $\mathbf{802}_2$, $\mathbf{802}_3$ for coupling to a power source. The electrodes $\mathbf{810}_1$, $\mathbf{810}_2$, and $\mathbf{810}_3$ are generally separated by a dielectric spacer 806 or an air gap and each form an independent electrode zone. The electrodes $\mathbf{810}_1$, $\mathbf{810}_2$, and $\mathbf{810}_3$ may include one or more apertures 820 to facilitate interfacing with one or more conductive elements, such as the ball assemblies depicted in FIG. 2.

Figure 9:
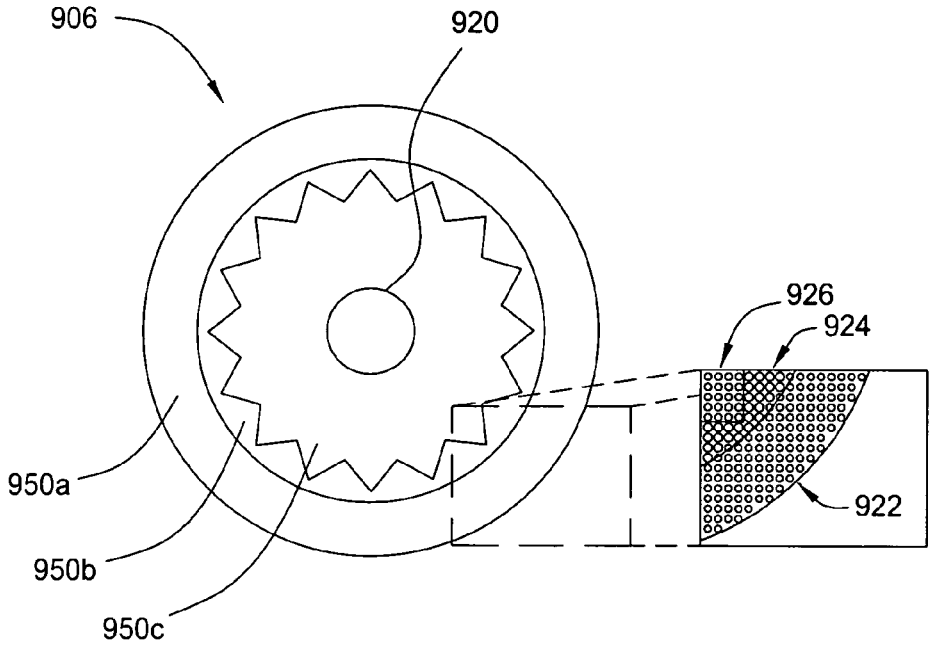
FIG. 9 is a plan view of another embodiment of an electrode of a zoned processing pad assembly of the processing station of FIG. 1.

FIG. 9 depicts a plan view of another embodiment of a zoned processing pad assembly 906 which matches the shape of an embedded electrode as described in FIG. 8. The zoned processing pad assembly 906 has at least one aperture 920 to facilitate interfacing with one or more conductive elements, such as the ball assemblies depicted in FIG. 2.

The zoned processing pad assembly has three zones 950 which are aligned with the shape of the electrodes $\mathbf{810}_1$, $\mathbf{810}_2$, and $\mathbf{810}_3$ described in FIG. 8. An outer zone 950(*a*) contains a first plurality of holes 922 with a first diameter and is disposed above electrode $\mathbf{810}_1$. An inner zone 950(*c*) contains a second plurality of holes 926 with a second diameter which is larger than the first diameter and is disposed above electrode $\mathbf{810}_3$. A central zone 450(*b*) contains a third plurality of holes 924 with a third diameter which is larger than the second diameter and is disposed above electrode $\mathbf{810}_2$. In the embodiment depicted in FIG. 9, the first, second, and third pluralities of holes, 922, 926, 924 are equally spaced. Alternatively, the holes could be independently spaced. This configuration provides a zoned processing pad assembly 906 in which the rate of removal of material from the substrate 120 is controlled in the zones 950(*a*), (*b*), and (*c*) to provide more uniformity of removal across the surface of the substrate.

Figure 10A:
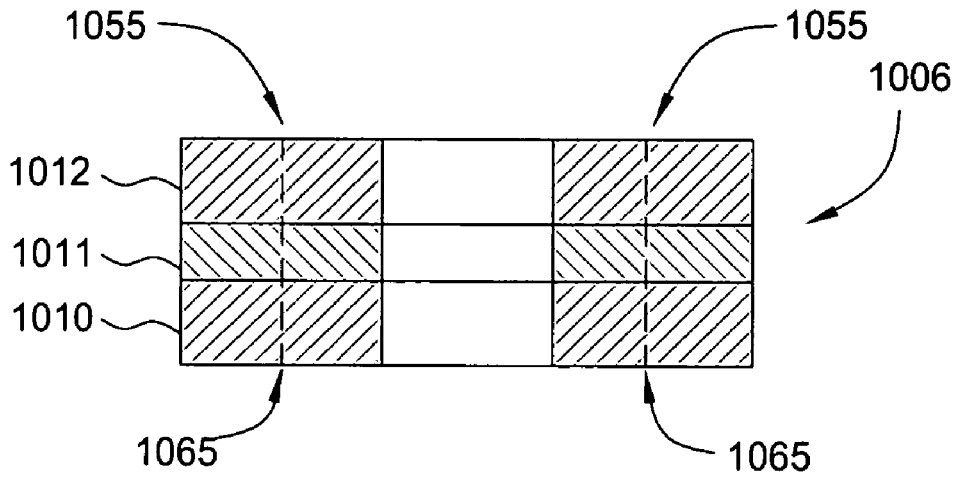
FIG. 10A is a cross-sectional side view of another embodiment of a zoned processing pad assembly having aligned zones.
Figure 10B:
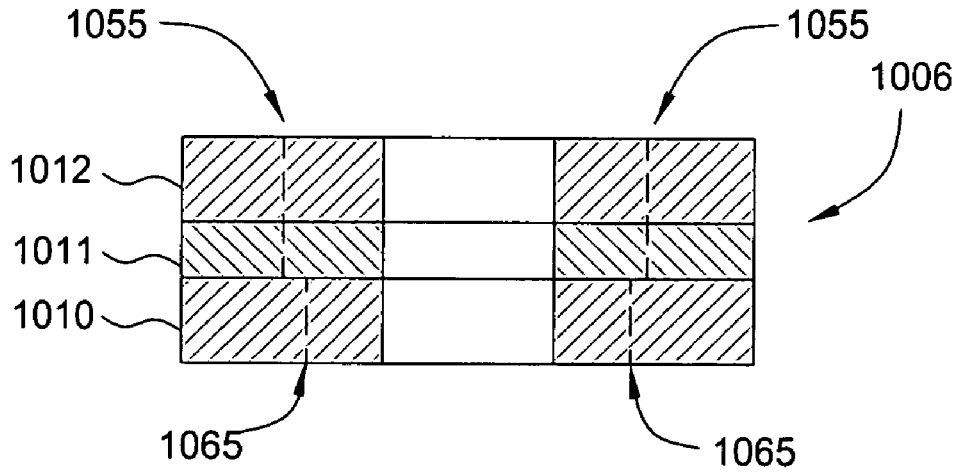
FIG. 10B is a cross-sectional side view of another embodiment of a zoned processing pad assembly having offset zones.

FIGS. 10(*a*) and 10(*b*) further illustrate the flexibility in creating zones within a zoned processing pad assembly 1006 utilizing the teachings disclosed herein. The zones in the processing pad assembly may be offset from the electrode(s) or may match the shape of the electrode(s) embedded within the processing pad assembly. Or, in cases where at least one of the lower conductive layer or upper layer of the processing pad assembly has three or more zones, the zones may be arranged in a combination of alignment and misalignment.

For example, FIG. 10(*a*) depicts a sectional side view of one embodiment of a processing pad assembly 1006 wherein the zones formed in the upper layer 1012 and optional subpad 1011 (shown illustratively by dividing line 1055) are aligned with the electrode zones formed in the lower conductive layer 1010 (shown illustratively by dividing line 1065). FIG. 10(*b*) depicts a sectional side view of the processing pad assembly 1006 wherein the zones formed in the upper layer 1012 and optional subpad 1011 (shown illustratively by dividing line 1055) are offset from the electrode zones formed in the lower conductive layer 1010 (shown illustratively by dividing line 1065).

Referring to FIGS. 1, 2, and 4, in operation, a substrate 120 retained in the carrier head 122 of the carrier head assembly 118 is held in contact with the upper layer 212 of the processing pad assembly 106. The carrier head assembly both rotates and oscillates the substrate 120 in a substantially planar motion while maintaining the substrate 120 in contact with the processing pad assembly 106. The processing pad assembly 106 is rotated by the platen assembly 142.

In one embodiment, a ball assembly 204 is disposed in a central aperture 420 of the processing pad assembly 406. The carrier head 122 maintains the substrate 120 in contact with the ball 224 of the ball assembly 204, thereby electrically coupling the substrate 120 to a power source 166. Electrolyte flows from an electrolyte source 170 through one or more apertures 234 formed in the ball assembly 204 and into contact with the substrate 120 and across the surface of the processing pad assembly 406. The electrolyte further travels downwards through the plurality of holes 420, 422 in the processing pad assembly 406 and into contact with the conductive layer 210 embedded in the processing pad assembly 406 and coupled to the power source 166.

The quantity of electrolyte filling the plurality of holes 420 is different than that filling the holes 422 due to their different diameters. This causes the impedance of the zones 450 to be different. The difference in impedance of the zones 450 may be controlled by the distribution of at least one of hole sizes, hole number, hole spacing, geometries, porosity or permeability and the like. The differing impedances of the zones causes different current flows through each of the zones 450. The different current flow through the zones 450 alters the rate of copper removal from the surface of the substrate 120 above each of the respective zones 450. Further control and flexibility over the rate of removal may be had by the combination of zones of different current permeability along with the electrode zones as described above with respect to FIGS. 7–10.

For example, a processing pad assembly having the electrode 810 of FIG. 8 (having three electrode zones) used with a uniformly perforated upper layer (same perforation density in each zone corresponding to the electrode 810) would require, for example, voltages $V_1$=2.9V applied to electrode $\mathbf{810}_1$, $V_2$=3.6V applied to electrode $\mathbf{810}_2$, and $V_3$=2.0V applied to electrode $\mathbf{810}_3$ in order to uniformly polish a substrate 120 in a given time period. Since there is a one-to-one correspondence between voltage and current density (in electrochemical reactions, the current density is usually an exponential function of voltage), the current density in zone 2 would be greater than the current density in zone 1, which would be greater than the current density in zone 3.

The rate of removal of material from the surface of the substrate 120 is driven by the total charge, which can be controlled by increasing or reducing the current density. Current density is inversely proportional to impedance, which may be controlled, as described above, by the open area in the zone. Thus, the current density may be increased or reduced by reducing or increasing the open area, respectively. By having greater open area in zone 2 with respect to zone 1, and lesser open area in zone 3, the voltages may be brought closer to each other, e.g., $V_1$=2.9V, $V_2$=3.1V, $V_3$=2.7V, while maintaining a uniform polishing profile in a given time period across all the zones. This advantageously reduces the leakage current (i.e., the current that flows from one zone to the next without contributing to the reaction), which improves the accuracy of endpoint detection by measuring charge. A further advantage is the widening of the process window. If the current density gets to high, the planarization capability is lost.

Thus, a processing station having a multi-zoned processing pad assembly creating multiple zones adapted to remove material from a substrate at a uniform rate has been provided. The multi-zoned processing pad assembly allows the rate of removal of copper from the surface of a semiconductor substrate to be uniformly controlled.

While the foregoing is directed to the illustrative embodiment of the present invention, other and further embodiments of the invention may be devised without departing from the basic scope thereof, and the scope thereof is determined by the claims that follow.

The invention claimed is:

1. A multi-zoned processing pad assembly for processing a substrate, comprising:

a conductive layer;

an upper layer having a non-conductive processing surface coupled to the conductive layer;

a conductive surface positioned substantially coplanar with the non-conductive processing surface, wherein a side of the substrate disposed on the upper layer contacts the conductive and non-conductive processing surface; and at least two zones of different current permeability defined across the processing surface of the upper layer, wherein the at least two zones are defined by an attribute of the upper layer.

2. The assembly of claim 1, further comprising at least one aperture formed through the upper layer and the conductive layer.

3. The assembly of claim 1, wherein the at least two zones are formed via at least two sets of a plurality of holes in at least the upper layer, wherein the holes in each set of holes have substantially equal spacing but different diameters.

4. The assembly of claim 1, wherein the at least two zones are formed via at least two sets of a plurality of holes in at least the upper layer, wherein the holes in each set of holes have substantially equal diameters but different spacing.

5. The assembly of claim 1, wherein the at least two zones are formed via at least two sets of a plurality of holes in at least the upper layer, wherein the holes in each set of holes have different diameters and different spacing.

6. The assembly of claim 1, wherein the upper layer is fabricated of a permeable material, and wherein the at least two zones is defined by portions of the upper layer having different permeability.

7. The assembly of claim 1, wherein the upper layer further comprises:

a first ring of permeable material; and at least a second ring of permeable material coupled to the first ring, wherein the first and second rings of permeable material have different porosity.

8. The assembly of claim 1, further comprising a subpad disposed between the upper layer and the conductive layer.

9. The assembly of claim 1, wherein the conductive layer further comprises a plurality of independently biasable electrical zones.

10. The assembly of claim 1, wherein the at least two zones further comprises a first zone having a greater open area than a second zone.

11. The assembly of claim 1, wherein the at least two zones further comprises a first zone adapted to allow a greater volume of electrolyte therethrough relative to a second zone.

12. The assembly of claim 1, further comprising:

a terminal disposed to the conductive layer for coupling to a power source, and a subpad coupled to the conductive layer.

13. The assembly of claim 12, further comprising at least one aperture formed through the upper layer, the subpad, and the conductive layer.

14. The assembly of claim 1, wherein the conductive surface is coupled to a power source.

15. The assembly of claim 14, wherein the plurality of independently biasable electrical zones further comprises three independently biasable electrical zones formed by the interaction between a first conductive element and a second conductive element disposed in the conductive layer, wherein the second conductive element has an inner edge interleaved with an outer edge of the first conductive element.

16. The assembly of claim 15, wherein the at least two zones further comprises three zones aligned above the three electrical zones.

17. The assembly of claim 1, wherein the contact assembly is configured to bias a substrate during processing.

18. The assembly of claim 1, wherein electrolyte is supplied to the upper layer through the contact assembly.

* * * * *

UNITED STATES PATENT AND TRADEMARK OFFICE

CERTIFICATE OF CORRECTION

PATENT NO. : 7,186,164 B2
APPLICATION NO. : 10/727774
DATED : March 6, 2007
INVENTOR(S) : Antoine P. Manens It is certified that error appears in the above-identified patent and that said Letters Patent is hereby corrected as shown below:

Column 3, Line 8: Change “of the of the” to --of the--

Column 5, Line 14: After “POLISHING””, insert --)--

Column 5, Line 17: After “POLISHING””, insert --)--

Column 8, Line 5: Change “at three” to --three--

Column 10, Line 20: Change “to” to --too--

Signed and Sealed this

Twelfth Day of June, 2007

JON W. DUDAS
*Director of the United States Patent and Trademark Office*